United States Patent [19]

Berlie et al.

[11] 4,392,816

[45] Jul. 12, 1983

[54] WASTE GAS INCINERATOR

[75] Inventors: Elmer M. Berlie; John D. Smart, both of Alberta, Canada

[73] Assignee: Western Research and Development, Calgary, Canada

[21] Appl. No.: 239,553

[22] Filed: Mar. 2, 1981

[51] Int. Cl.[3] ..... F23D 13/20

[52] U.S. Cl. ..... 431/202; 422/182; 431/5

[58] Field of Search ..... 431/5, 202, 285, 284; 422/182

[56] References Cited

U.S. PATENT DOCUMENTS

| | | | |
|---|---|---|---|
| 3,930,802 | 1/1976 | Beasley et al. | 431/202 X |
| 4,101,261 | 7/1978 | Straitz | 431/13 X |
| 4,140,471 | 2/1979 | Straitz et al. | 431/202 X |

*Primary Examiner*—Edward G. Favors

*Attorney, Agent, or Firm*—Larson and Taylor

[57] ABSTRACT

A waste gas incinerator for burning waste gases is disclosed. The incinerator ensures substantially complete combustion of toxic and odoriferous compounds under high wind conditions, erratic flow rates and low ambient temperatures. The incinerator comprises an upright refractory liner generally cylindrical casing forming a heat sink, and has an open upper end and a lower end. An upper wind shroud is provided adjacent the open upper end and a lower wind shroud adjacent the lower end, both wind shrouds have a generally cylindrical shape with a larger diameter than the casing and a plurality of openings spaced around the wind shrouds. Air access is provided at the lower end of the casing, the access having a restrictor to limit air entry and cause turbulent air flow in the casing, and a waste gas entry to the casing.

7 Claims, 6 Drawing Figures

Fig. 2
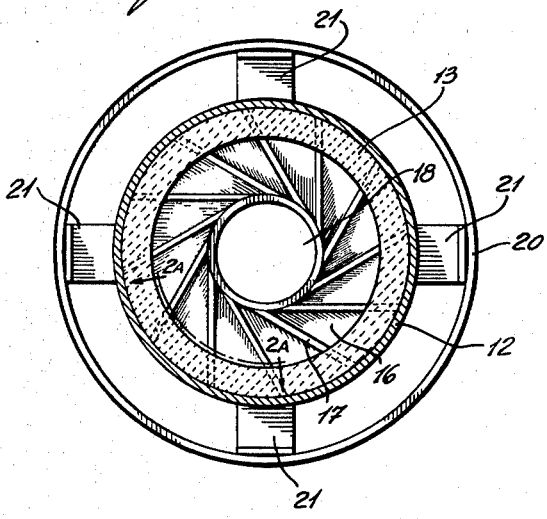
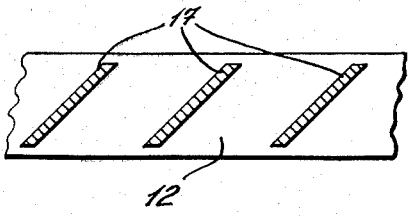
Fig. 2A
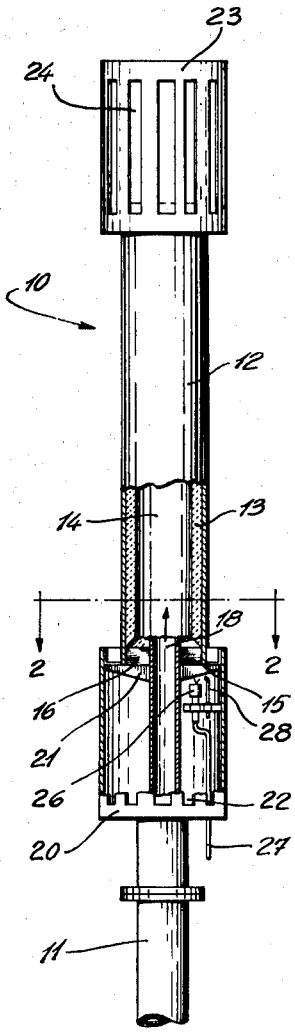
Fig. 1

WASTE GAS INCINERATOR

The present invention relates to waste gas flares, and more particularly to the combustion of combustible gases produced from industrial operations including oil and gas wells.

Waste gases have been burned for a number of years, using flares, typically a pipe with an elevated exit. Such gases include combustible gases mixed with inert gases such as nitrogen and carbon dioxide and also generally include toxic or odoriferous gases such as hydrogen sulfide and mercaptans. Due to high quantities of inert gas, erratic flow rates, high winds and low ambient temperatures, it is often found that neither the temperature of combustion is sufficiently high, nor the time of combustion sufficiently long, and in many cases these gases are not consumed which results in air pollution and serious complaints and objections from residents in built-up areas. To overcome this air pollution problem, it has been found that a flare can be replaced by an incinerator which provides a controlled combustion of the gases at a higher temperature than a normal flare. In addition the waste gases have a residence time in the incinerator, thus consuming the odoriferous gases and compounds.

Waste gas incinerators have been partially successful in the past, however, a number of problems have occurred with these incinerators. One problem is due to the variation in the flow of waste gases into the incinerator. It has been found that certain conditions occur when there is not sufficient combustible gas present in the incinerator, and too much air is drawn in, thus cooling the burning waste gases and resulting in some of the odoriferous waste gases not being consumed. Another problem is high winds which cause low pressure areas resulting in draughts within the incinerator and downwash outside the incinerator. In some cases the flame is blown out, in other cases combustion occurs outside the incinerator which cools the burning waste gases resulting in incomplete combustion, particularly of the toxic compounds.

We have found that an improved waste gas incinerator may be formed from a refractory lined pipe larger in diameter than the waste gas pipe line, to form a combustion chamber. The length of the refractory lined pipe is such that substantially complete combustion of waste gases occurs within the combustion chamber. The combustion chamber has at least one opening at the bottom and is open at the top. The bottom opening forming an air access which has a restriction therein to control the quantity and turbulence of air entering the combustion chamber from the bottom opening. Thus there is no free laminar air flow into the combustion chamber, but rather a restricted turbulent air flow. This restricted turbulent flow minimizes excess air and ensures substantially complete combustion occurs regardless of the quantity of waste gas entering the combustion chamber. A flame may protrude from the top of the incinerator at high flow rates.

Two other features of the present invention include a lower wind shroud around the bottom opening of the refractory lined pipe, and an upper wind shroud around the open top of the refractory lined pipe. The wind shrouds prevent areas of low pressure occurring at the bottom opening and open top which may affect complete combustion of the waste gases.

The present invention provides a waste gas incinerator comprising an upright refractory lined generally cylindrical casing forming a combustion chamber and heat sink, having an open upper end and a lower end, an upper wind shroud adjacent the open upper end and a lower wind shroud adjacent the lower end, both wind shrouds having a generally cylindrical shape with a larger diameter than the casing, and a plurality of openings spaced around the wind shrouds, air access at the lower end of the casing, the access having a restriction means to limit air entry and cause turbulent air flow in the casing, and waste gas entry to the casing.

In preferred embodiments of the invention, a pilot light may be mounted within the casing adjacent the waste gas entry. The restriction means in the air access may include a plurality of air vanes located between the inner wall of the casing and the waste gas entry, the air vanes being positioned at an angle to give air entering the air access a swirling action to mix with waste gas entering the casing. In other embodiments the openings in the wind shrouds represent about half the area of the generally cylindrical shape and may be vertical slots.

In one embodiment the casing comprises a stack mounted on a foundation, the lower wind shroud, air access and waste gas entry, are accessible from ground level and the upper wind shroud and open upper end of the casing are at least about 40 feet above the ground. In another embodiment the casing is made for mounting on the top end of a vertical waste gas pipe.

In yet a further embodiment there is provided a method for incinerating a combustible gas in an upright refractory lined generally cylindrical casing, having an open upper end and a lower end comprising the steps of, feeding the gas to the lower end of the casing, preventing a low pressure area at the lower end of the casing due to wind by means of a lower wind shroud having openings therein, admitting a limited amount of air in a turbulent flow to the lower end of the casing to mix with the gas, igniting the mixture of air and gas within the casing, maintaining combustion of the gas within the casing at a sufficient temperature and for a sufficient time to attain substantially complete combustion of the gas before discharging from the open upper end of the casing, and preventing quenching and downwash at the open upper end of the casing due to wind, by means of an upper wind shroud having openings therein.

In drawings which illustrate the embodiments of the invention,

FIG. 1 is an elevational view, partly in section, of a waste gas incinerator according to one embodiment of the present invention.

FIG. 2 is a sectional view taken at line 2—2 of FIG. 1.

FIG. 2A is a partial sectional view taken at 2A—2A of FIG. 2.

Figure 3:
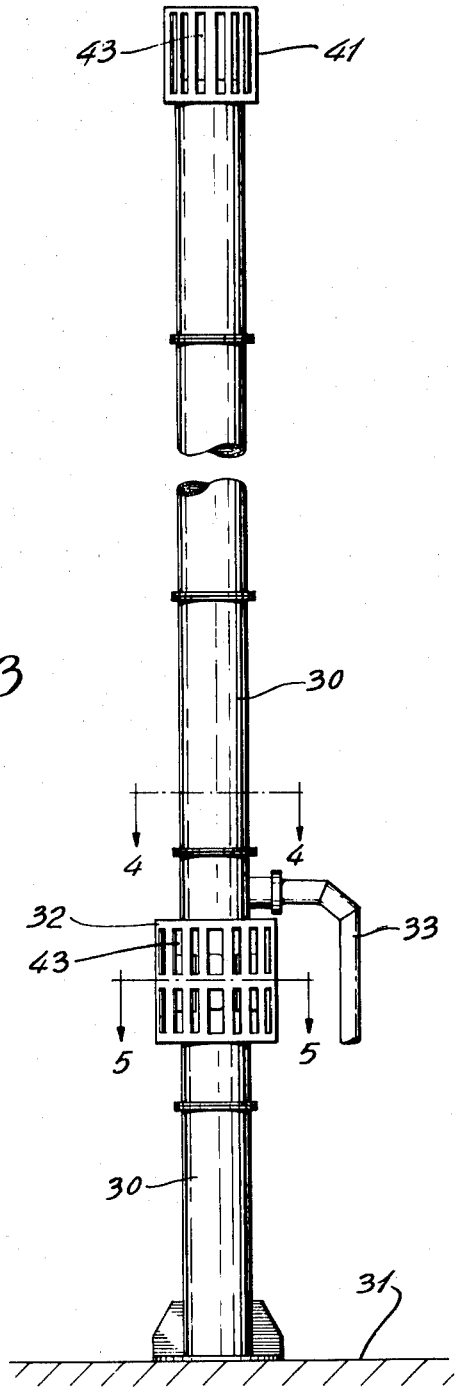
FIG. 3 is an elevational view of another embodiment of a waste gas incinerator according to the present invention.

Referring to FIGS. 1 and 2, a waste gas incinerator 10 is shown mounted on top of a vertical waste gas pipe 11. It is preferred that the top of the waste gas incincerator is at least about 40 feet above the ground. The waste gas incinerator 10 has a generally cylindrical casing 12 lined with a refractory material 13. The refractory liner 13 is preferably in the order of 1" thick made from a clay-cast refractory material to provide an insulator and heat sink to form a combustion chamber 14 within the casing 12. At the lower end 15 of the chamber 14 is an air restrictor 16 which comprises a plurality of vanes 17 as illustrated in FIG. 2A, positioned at an angle of approximately 45 degrees and extending from the internal surface at the lower end 15 of the casing 12 to the waste gas pipe 18, filling the annular space formed therebetween. The number of vanes 17 and the angle of vanes is dependent upon the air-flow requirement into the combustion chamber 14. If there is insufficient restriction, too much air enters the chamber 14, and the temperature of combustion may be below that at which some of the toxic compounds are consumed. If there is insufficient air entering the chamber, complete combustion does not take place. Air enters the combustion chamber with a turbulent flow and mixes with the waste gases from the waste pipe 18. The combustion chamber 14 has a sufficient length so that the mixture of air and waste gases remain in the chamber 14 long enough for complete combustion to occur. The temperature within the chamber 14 is sufficiently high caused by the refractory material 13 retaining the heat from combustion and forming a heat sink so that all the toxic materials in the waste gases are consumed.

A lower wind shroud 20 cylindrical in shape with an open top and bottom is supported on brackets 21 attached to the waste gas pipe 18 and surrounds the lower end 15 of the casing 12. The brackets 21 also support the casing 12. In the embodiment shown lower wind shroud 20 has a plurality of vertical slots 22, the slots preferably represent approximately half of the circumferential area of the lower wind shroud 20. Whereas vertical slots are shown in the drawing, round holes or almost any shape of openings are satisfactory, however, it is preferred that the openings represent approximately half the circumferential area of the shroud. An upper wind shroud 23, cylindrical in shape with an open top and bottom, is positioned about the open upper end of the casing 12, and in the embodiment shown has a plurality of vertical slots 24 as in the lower wind shroud 20. As in the lower wind shroud 20 it is preferred that the slots 24 represent approximately half the circumferential area. Whereas vertical slots are shown in the drawing, round holes or almost any shape of openings are satisfactory, however, it is preferred that the openings represent approximately half the circumferential area of the shroud. The upper wind shroud 23 is preferably made from stainless steel so that it can withstand the high temperatures of combustion and hot gases exiting from the combustion chamber 14. The lower wind shroud 20 may be made from aluminum as it acts only on air entering the air restrictor 16. In practice it has been found that the lower wind shroud 20 prevents areas of low pressure adjacent the air restrictor 16 and within the combustion chamber 14, thus allowing a substantially constant flow of air into the combustion chamber at practically all wind conditions. Furthermore, it has been found that if there is a variation in the waste gas flow into the combustion chamber 14, then the air entering the chamber 14 through the restrictor 16 varies to a certain extent to match the waste gas flow through the waste gas pipe 18 into the chamber 14. The upper wind shroud 23 prevents down-draughts into the combustion chamber 14 which creates an adverse effect on combustion within the chamber. The upper wind shroud 23 also prevents quenching of the flame at the open top of the incinerator and acts as a flame holder within which combustion of hydrogen, carbon monoxide and light hydrocarbon materials, such as methane, are completed.

A pilot light 26 is provided below the air restrictor 16 within the lower wind shroud 20. The pilot light 26 has a gas pipe line 27 to fuel the pilot light and an electric ignition system 28 is provided to ignite the pilot if it should go out. An access door (not shown) may be provided in the lower wind shroud 20 for maintenance of the pilot light. Thus, if there is a condition when no waste gases flow through the waste gas pipe 18 and combustion within the combustion chamber 14 is extinguished, then the pilot light provides ignition when the waste gases commence to flow again.

In the embodiment shown in FIGS. 1 and 2 the length of the refractory lined casing 12 is between 4–8 feet. The diameter of the casing 12 is approximately 8 inches with a 1 inch thick refractory lining, and the waste gases enter through a pipe 2 to 3 inches in diameter.

Figure 5:
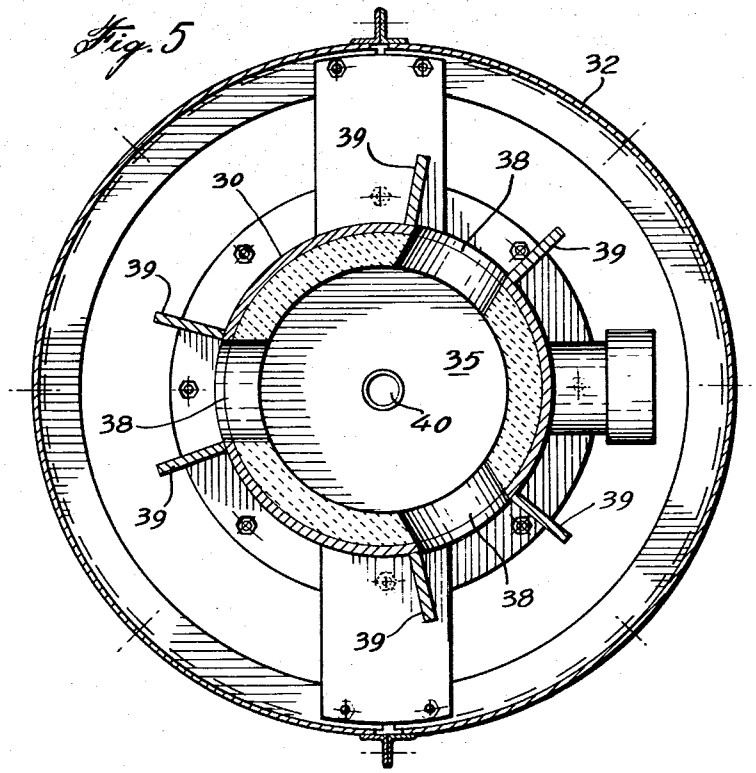
FIG. 5 is a sectional view taken at line 5—5 of FIG. 3.
Figure 4:
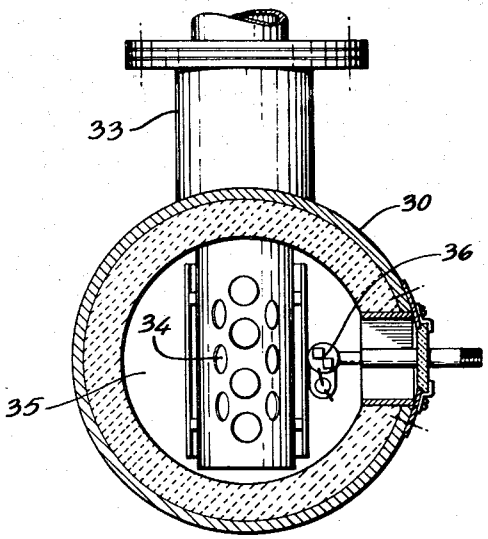
FIG. 4 is a sectional view taken at line 4—4 of FIG. 3.

Another embodiment of a waste gas incinerator is illustrated in FIGS. 3–5. The unit shown has a large diameter pipe formed in casing sections 30, each casing section having flanges so it may be easily connected to adjoining sections. The large diameter pipe is supported vertically from a concrete base 31 on the ground and in a typical installation extends upwards for at least about 40 feet, thus ensuring that the consumed waste gases which exit from the open top of the incinerator are adequately dispersed to prevent high ground level concentrations of pollutants. The bottom wind shroud 32 and waste gas pipe 33 are accessible from the ground either being within the reach of an operator or alternatively, having a small service platform constructed. The waste gas pipe entry to the combustion chamber is illustrated in FIG. 4 wherein the waste gas pipe 33 enters perpendicularly to the casing section 30 and has a plurality of holes 34 on the top portion of the pipe 33 so that waste gases are directed upwards within the combustion chamber 35. The pilot light assembly 36 is illustrated in FIG. 4 adjacent the waste gas pipe 33 within the chamber 35.

As shown in FIG. 5, three restricted access holes 38 are evenly spaced around the circumference of the casing section 30. The number of access holes 38 may vary depending upon flow rates, composition of waste gases, and size of casing. Each of the holes 38 has side guides 39 to structurally strengthen the casing and prevent wind affecting the air entering the combustion chamber 35. The three holes 38 are of a predetermined size to act as a restrictor and perform the same function as the air vanes of the embodiment shown in FIG. 2. The air entering the combustion chamber 35 has a turbulent flow, thus ensuring that it mixes with the waste gas from the holes 34 in the waste gas pipe 33. A drain 40 is provided below the air access holes 38 for liquid hydrocarbons and water which may be entrained in the waste gases entering the combustion chamber. An upper wind shroud 41 is positioned at the open upper end of the top casing section 30. As illustrated in the drawings, both the upper wind shroud 41 and the lower wind shroud 32 have vertical slots 43 therein which perform the same function as discussed in the previous embodiment of the waste gas incinerator shown in FIGS. 1 and 2. As shown in FIG. 3, the combustion chamber 35 within the casing sections 30 is considerably longer than that shown in FIGS. 1 and 2, thus more air and waste gases is allowed to enter the combustion chamber 35, as the speed of the mixture of air and waste gases rising up through the combustion chamber 35 still has the same retention time within the chamber 35, due to its greater length, and therefore complete combustion occurs. Only in certain instances when an excess of waste gas flows into the incinerator does combustion occur not only in the chamber 35 but also above the incinerator. The refractory lining within the casing sections again results in a heat sink, ensuring a sufficiently high temperature within the chamber 35 to ensure that all the toxic gases and other compounds are consumed.

In operation waste gas enters the combustion chamber 35 through the plurality of holes 34 in the waste gas pipe 33 and is initially ignited by the pilot light 36. Once combustion commences, the pilot light only provides further ignition if there is an interruption in the gas flow. Air enters through the access holes 38 and forms a turbulent air flow resulting in good mixing of the air and waste gases within the combustion chamber 35. Combustion mostly occurs within the chamber 35 at a sufficiently high temperature and for sufficient time to obtain substantially complete combustion of the gases and toxic compounds contained therein before the consumed gases are discharged from the open upper end of the casing 30. At high flow rates a flame may protrude from the open upper end of the chamber 35. The lower wind shroud 32, which surrounds the air access holes 38, prevents low pressure areas within the combustion chamber 35 and ensures there is a reasonably constant flow of air through the air access holes 38 regardless of wind conditions. The upper wind shroud 41 prevents quenching and downwash at the open upper end of the casing, and only at high flow rates does some waste gas burn outside the combustion chamber 14.

Various changes to the embodiments illustrated herein may be made without departing from the scope of the present invention. It is important that air flow be restricted and turbulent within the combustion chamber and that the combustion of waste gases occur at a sufficiently high temperature and for a sufficient period within the chamber to ensure complete combustion. Furthermore, the upper and lower wind shrouds are needed to prevent variations in air flow and combustion in the chamber due to downwash, quenching and areas of low pressure from high wind conditions.

The embodiments of the invention in which an exclusive property or privilege is claimed are defined as follows:

1. A waste gas incinerator comprising, an upright refractory lined, generally cylindrical casing, forming a combustion chamber and heat sink, having an open upper end and a lower end, an upper wind shroud adjacent the open upper end and a lower wind shroud adjacent the lower end, both wind shrouds having a generally cylindrical shape with a larger diameter than the casing and a plurality of openings comprising vertical slots spaced around the wind shrouds, air access at the lower end of the casing within the lower wind shroud, the access having a restriction means to limit air entry and cause turbulent air flow in the casing, and waste gas entry to the casing.

2. The incinerator according to claim 1 including a pilot light mounted within the casing adjacent the waste gas entry.

3. The incinerator according to claim 1 wherein the restriction means in the air access includes a plurality of air vanes located between the inner wall of the casing and the waste gas entry, the air vanes positioned at an angle to give air entering the air access a swirling action to mix with waste gas entering the casing.

4. The incinerator according to claim 1 wherein the openings in the wind shrouds represent about half the area of the generally cylindrical shape.

5. The incinerator according to claim 4 wherein the top shroud is made of stainless steel.

6. The incinerator according to claim 1 wherein the casing comprises a stack mounted on a foundation, the lower wind shroud, air access and waste gas entry are accessible from ground level, and the upper wind shroud and open upper end of the casing are at least about 40 feet above the ground level.

7. The incinerator according to claim 1 wherein the casing is made for mounting on the top end of a vertical waste gas pipe and the overall height of the incinerator does not exceed about eight feet.

* * * * *